US005713431A

United States Patent [19]

Göhler et al.

[11] Patent Number: 5,713,431

[45] Date of Patent: Feb. 3, 1998

[54] APPARATUS FOR LUBRICATION OF THE BEARINGS OF LOWER ROLLERS OF A DRAW FRAME FOR TEXTILE FIBER MATERIAL

[75] Inventors: Wolfgang Göhler, Lenting; Michael Strobel, Eichstätt, both of Germany

[73] Assignee: Rieter Ingolstadt Spinnereimaschinenbau AG, Ingolstadt, Germany

[21] Appl. No.: 768,978

[22] Filed: Dec. 18, 1996

[30] Foreign Application Priority Data

Dec. 22, 1995 [DE] Germany ..... 195 48 241.7

[51] Int. Cl.[6] ..... F01M 1/06

[52] U.S. Cl. ..... 184/7.1; 184/8; 19/285

[58] Field of Search ..... 184/6, 7.1, 7.4, 184/8; 19/285, 293

[56] References Cited

U.S. PATENT DOCUMENTS

| | | | |
|---|---|---|---|
| 3,945,466 | 3/1976 | Zodrow et al. | 184/7.4 |
| 4,051,922 | 10/1977 | Sukle | 184/7.4 |
| 4,346,801 | 8/1982 | Redder et al. | 277/29 |
| 5,192,139 | 3/1993 | Hiramoto et al. | 384/476 |

FOREIGN PATENT DOCUMENTS

| | | | |
|---|---|---|---|
| 7472 | of 1911 | United Kingdom | 19/285 |

OTHER PUBLICATIONS

German Search Report, Apr. 2, 1996.

High-Speed Drawing Frame Brochure, Howa Machinery Not Dated.

Unterwalzenlager Spinnmaschine Und Flyer SKF Kugellagerfabriken GmbH-Berich Textilmaschinen Not Dated.

*Primary Examiner*—Thomas E. Denion

*Attorney, Agent, or Firm*—Dority & Manning

[57] ABSTRACT

A system for lubricating the lower roller bearings of a textile machine drafting equipment includes a base body with punched-out shapes movably mounted on the base body by way of adjusting devices. Bores are defined in the punched-out shapes for receipt of the lower roller bearings. An encapsulated lubrication system supplies lubricant to the bearings and includes a channel defined through the punched-out shape with an outlet into the bore and an inlet in communication with the channel defined through the base body which is in further communication with a source of lubricant at one end thereof. An excess lubricant removal channel is defined in the punched-out shape and has an opening in communication with the bore and an outlet on a side of the punched-out shape away from the operating area or space of the lower roller.

11 Claims, 5 Drawing Sheets

APPARATUS FOR LUBRICATION OF THE BEARINGS OF LOWER ROLLERS OF A DRAW FRAME FOR TEXTILE FIBER MATERIAL

BACKGROUND OF THE INVENTION

The present application relates to a process and to a device for the lubrication of the bearings of the lower rollers of a draw frame for textile fiber material. The bearing to support the ends of the lower rollers of a draw frame require re-lubrication since these are not so-called "lifetime" bearings.

With the draw frame model RSB 851 of RIETER Ingolstadt Spinnereimaschinenbau AG, a 3-over-3 drafting equipment with a pressure rod is used. This drafting equipment serves to process short-staple fiber material. It is suitable for the processing of cotton fibers from comber waste to chemical fiber with 80 mm. The drafting equipment consists of a pair of input rollers, a central roller pair and a pair of delivery rollers.

Each pair of rollers comprises a lower roller and an upper roller. In operating position, the upper rollers, which are supported in a separate holding and loading device (pressure arms) are pressed down on the lower roller. During a stoppage, the upper rollers can be lifted in their holding device from the lower rollers.

The lower rollers are supported in needle bearings. The individual bearings are each contained in an appertaining punched-out shape which is in turn located on a base body of the drafting equipment. The recess is here connected to an adjusting device in order to render the width of the drafting field between two roller pairs adjustable. At the top of each punched-out shape a nipple is provided leading through a channel in the axial direction to a bearing of a lower bearing and constituting a lubrication point there. Aeration of the bearing is effected in the axial direction via sealing elements of the bearing, so that displaced, excess lubricant (old, used-up grease) is also removed into the lower operating space of the drafting equipment.

FIG. 1 on page 5 of the brochure "High-Speed Drawing Frame DFH" of the Howa Machinery, LTD of December 1992 clearly shows the nipple for the lubrication of the bearing of the lower rollers. In that case every bearing of the lower roller must be lubricated by manual application of a grease-gun to the nipple. As this illustration further shows, lubrication is only possible when the drafting equipment is stopped and the upper rollers have been lifted off the lower rollers or when the holding and loading device (pressure arms) have been removed.

Manual lubrication continues as a rule with such quantities of lubricant (quantities of grease) until displaced old grease accumulates outside against the bearing, from where it goes into the lower operating space of the drafting equipment. Since lubrication is carried out in predetermined time intervals, large amounts of lubricant accumulate in the lower operating space and collects mostly dirt and fiber fly from the operating space. This leads to increased soiling of the lower operating space. This may result in individual grease particles to be conveyed into the fiber material by the air stream which is in particular constituted by the suction system taking effect in the operating space, and to affect the quality of the fiber material adversely.

Especially at fiber material delivery speeds of over 900 m/min, greater dynamics of the drafting equipment rollers takes place. This leads also to increased mechanical stress of the lower rollers. When the lubricant quantity is manually dosed too sparingly, increased friction and increased wear may occur at the bearing due to insufficient lubrication.

OBJECTS AND SUMMARY OF THE INVENTION

It is a principal object of the present invention to avoid an accumulation of lubricant residue in the operating space of a drafting equipment for textile fiber material. Additional objects and advantages of the invention will be set forth in part in the following description, or may be obvious from the description, or may be learned through practice of the invention.

By using the present inventive lubrication process, it is possible to minimize the consumption of lubricant. The result attained is that after a certain time interval, only so much lubricant is added as is actually necessary to maintain the film of lubricant in the bearing. As an alternative solution, the possibility thus exists in a preferred embodiment that lubricant is automatically fed to the bearing also during operation.

During operation, the bearing can be supplied with lubricant via a specially laid-out channel in the punched-out shape and via coupled, encapsulated means in combination with a controllable apparatus. A suitable control program defines in that case the points in time for lubrication according to a selected time interval.

The adjusting means of the punched-out shape are part of the encapsulated means.

It is thereby no longer necessary to stop the draw frame to lubricate the bearing. This is a new advantage over the state of the art in drafting equipment of the textile industry.

The device for the lubrication of the bearing for lower rollers of drafting equipment makes it possible for the supplied lubricant to no longer enter the lower operating space of the drafting equipment. For this, provisions are made so that each channel located in a punched-out shape which serves for the feeding of lubricant to a bearing of a lower roller is connected via encapsulated means to a lubricant conveying system with centrally acting, controllable means for lubricant supply. This channel in the punched-out shape leads from its opening down in the base surface of the punched-out shape in the direction of the bore of the bearing, where it lets out. The base surface of the punched-out shape is constituted by those surfaces which are in contact with the base body and/or the adjusting means of the drafting equipment.

In a drafting equipment with adjusting means for the punched-out shape, the adjusting means is advantageously made to serve a double function. In addition to the original function of adjusting the width of the drafting field, the adjusting means also contains a channel going through it and capable of being coupled, so that the adjusting means also become part of the encapsulated means. Other elements of the encapsulated means are pipelines and connection means. The encapsulated means constitutes the connection from the channel of the punched-out shape to the controlled means for lubricant supply.

The advantageous design of the encapsulated means make it possible for the lubricant supply to be ensured below as well as within bearing means (base body of the drafting equipment) and guiding means (adjusting means) of a punched-out shape. Thus, the operating space of a drafting equipment is freed of pipelines for lubricant supply.

The controlled means for lubricant supply comprises at least a container for lubricant, means for the production of pressure upon the lubricant, and controls for the production of the pressure. In an advantageous embodiment the controls for the production of pressure may be integrated in the machine computer of the textile machine, and otherwise the controls can be installed separately on the textile machine.

In addition, the punched-out shape is provided with an opening of another channel in the side of the bore receiving the bearing, this opening being preferably located above the bearing. This channel lets out on the side of the punched-out shape away from the operating space. In a preferred embodiment, the channel letting out at that location (the side away from the operating space) can be connected to a discharge line which conveys the old lubricant residues into a container. This has the advantage that the operating space of the drive means of the drafting rollers is also kept free of lubricant residue.

This advantage is also achieved by deflecting and removing lubricant into the punched-out shape across from the drive by means of a channel in the lower roller.

By contrast with the known state of the art, the device makes it advantageously possible to lubricate the bearing when the upper rollers have already been pressed down on the lower rollers or when the drafting equipment is in operation. This was not possible in the past.

An example of an embodiment of the invention is shown in the drawing and is described below in further detail.

DETAILED DESCRIPTION ON THE PREFERRED EMBODIMENTS

Figure 1:
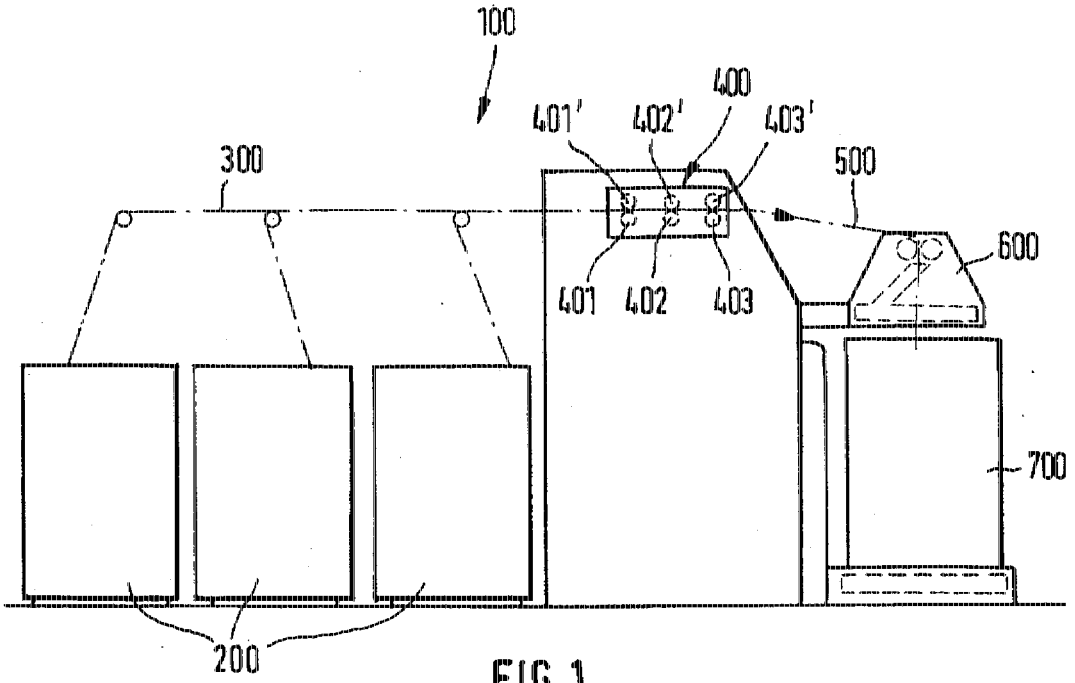
FIG. 1 shows a lateral view of a draw frame with drafting equipment for short-staple textile fiber material.

Reference will now be made in detail to the presently preferred embodiments of the invention, one or more examples of which are illustrated in the drawings. Each example is provided by way of explanation of the invention, and not as a limitation of the invention. For example, features illustrated or described as part of one embodiment can be used on another embodiment to yield a still further embodiment. It is intended that the present invention cover such modifications and variations as come within the scope of the appended claims and their equivalents.

FIG. 1 schematically shows a draw frame 100 in a side view. A fiber sliver 300 is taken from several filled cans 200. The draw frame 100 processes fiber material. Represented in dashed lines as doubled fiber slivers, an individual fiber sliver or fiber fleece. The fiber slivers fed from the cans 200 to the drafting equipment 400 are doubled and drafted. Working elements of the drafting equipment are individual roller pairs. FIG. 1 schematically shows a 3-over-3 drafting equipment. After the drafting equipment, the fiber material is compacted into a single, drafted fiber sliver and is then deposited by means of a rotating plate 600 in a can 700.

The drafting equipment 400 consists of 3 pairs of rollers, each consisting of a lower roller and an upper roller. In the direction of fiber material movement (see arrow), these roller pairs are designated as input roller pair 401, 401', central roller pair 402, 402' and delivery roller pair 403, 403'. The roller pairs are driven at the respective lower rollers, while the upper rollers are pressed down upon the lower rollers by pressure arms (not shown) (holding and loading device) during the operation and are slaved by the pressure.

The shown number of roller pairs is not binding. It would be absolutely possible to use more than three roller pairs, and also several upper rollers could be associated with one lower roller.

Figure 2:
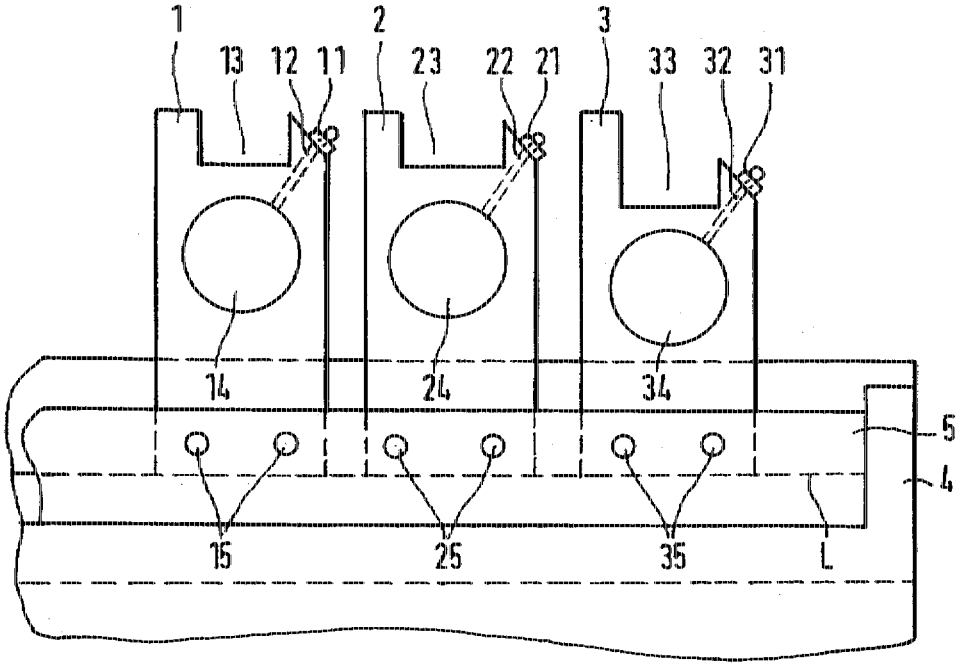
FIG. 2 shows a partial lateral view of the base body of a drafting equipment with punched-out shapes on one side of the drafting equipment to receive the upper and lower rollers.

FIG. 2 shows the schematic side view of a partial drafting equipment 400 for three drafting roller pairs which are received by a drafting equipment base body 4. The drafting equipment pairs, consisting of an upper roller 401' and a lower roller 401 (see FIG. 1) are held at their end in a punched-out shape. Upper and lower rollers are not shown in FIG. 2. The lateral view according to FIG. 2 only shows the punched-out shapes 1, 2, 3 of one side of a drafting equipment. The information given below is also applicable for the punched-out shapes on the other side of the drafting equipment. In one punched-out shape 1, 2, 3 a bore 14, 24, 34 is visible in which the bearing of the appertaining lower roller is received, as well as groove 13, 23, 33 in which the respective upper roller is supported.

The upper rollers can remain in the groove of the punched-out shapes after opening of the pressure arms (not shown) of the drafting equipment, or can be lifted up from the lower rollers together with the pressure arms during the opening and swiveling.

The corresponding upper rollers are aligned precisely relative to the lower rollers by the groove 13, 23, 33. The punched-out shapes 1, 2, 3 are supported on the drafting equipment base body 4 as is shown in FIG. 2 in punched-out shape of the broken line L only. The punched-out shapes 1, 2, 3 are attached to the drafting equipment base body 4 by means of adjusting devices 5 and appertaining connection means 15, 25, 35. Thanks to the connection means, accidental shifting or displacement of the drafting rollers relative to each other during operation is not possible. The drawing of the adjusting device is greatly simplified.

FIG. 2 shows the known state of the art with respect to lubrication of the bearing of the lower rollers.

At each punched-out shape, a nipple 11, 21, 31 is installed and from there a channel 12, 22, 32 goes from the top to the corresponding lower bore 14, 24, 334 which receives the corresponding bearing of the lower roller.

FIG. 2 shows the essential features, with the nipples, of the past practice for the lubrication of the bearing, i.e. the manual introduction of lubricant (grease) into the channel 12, 22, 32 with a grease gun via the nipple, with the grease distributing itself in the bearing (not shown in FIG. 2) and with the used, excess grease being displaced in axial direction via the seal (not shown) of the bearing. It becomes clear that the displaced grease can drop down on both sides of a punched-out shape. The grease thus enters the lower operating space of the drafting equipment. This has the disadvantage that grease residue is pulled along from the lower operating space, either by the suction air of a suction system on the drafting equipment or by the air current due to the rotation of the drafting rollers, and is brought into the path of the fiber material. This has a detrimental influence on the quality of the fiber material.

Figure 3:
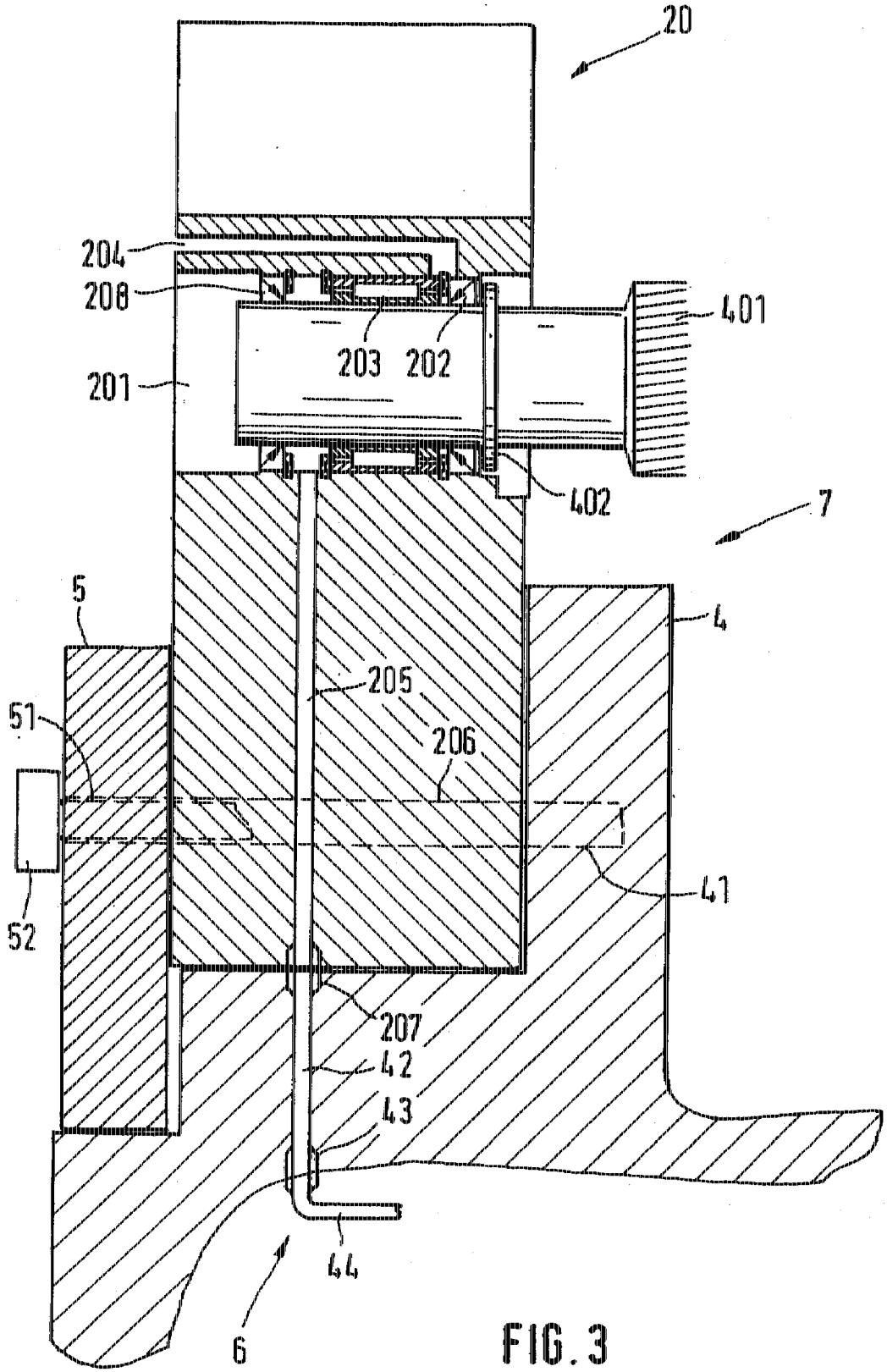
FIG. 3 shows a vertical section through a punched-out shape with base drafting equipment body and adjusting means.

FIG. 3 shows a horizontal section through a punched-out shape which is held in a base body of a drafting equipment. The punched-out shape 20 is located in a known manner on the drafting equipment base body 4. In this arrangement, the punched-out shape 20 is slid on a pipe-shaped connecting device 207 so that a connection is established between the channel 205 of punched-out shape 20 and the channel 42 of the drafting equipment base body 4. The punched-out shape 20 is then stopped in that it is clamped by means of adjusting device 5 to the drafting equipment base body 4. Clamping is achieved e.g. by making the bores 51, 206 and 41 which are aligned with each other in punched-out shape of threaded bores. By screwing the connection device 52 (e.g. a screw) into the three bores, clamping is achieved.

For a better understanding of the invention, the details of the bearing and of the lower roller are included in the sectional view of punched-out shape 20.

The bearing 203 is located in the bore 201 of the punched-out shape 20 and receives one end of the lower roller 401. The lower roller 401 lies with its bead 402 flush against the sealing element 202 of the bearing 203. On the other side of the bearing 203 a seal is ensured by the sealing element 208. The lower operating space 7 is shown in part below the lower roller 401.

The encapsulated means 6 for lubrication feed is constituted by the channel 42 in the drafting equipment base body 4 and by the pipeline 44. For a continuous connection between channel 205 and channel 42, a connecting device 207 is inserted at the point of transition. The connecting device 207 may be a rigid connecting device which serves at the same time for the adjustment of the punched-out shape 20 relative to the drafting equipment base body 4. The connecting device 207 may however also be made in punched-out shape of a flexible pipe connection.

A connecting device 43 is also provided between the drafting equipment base body 4 and the pipeline 44.

The lubricant is fed into the space between the sealing element 208 and the bearing 203 by this encapsulated means 6 for lubricant feed. With this type of lubricant feed, the excess lubricant is mostly displaced into the other channel 204. Channel 204 lets out on the side of punched-out shape 20 away from the operating space 7. This ensures that displaced lubricant quantities do not enter the lower operating space 7 of the drafting equipment.

Figure 4:
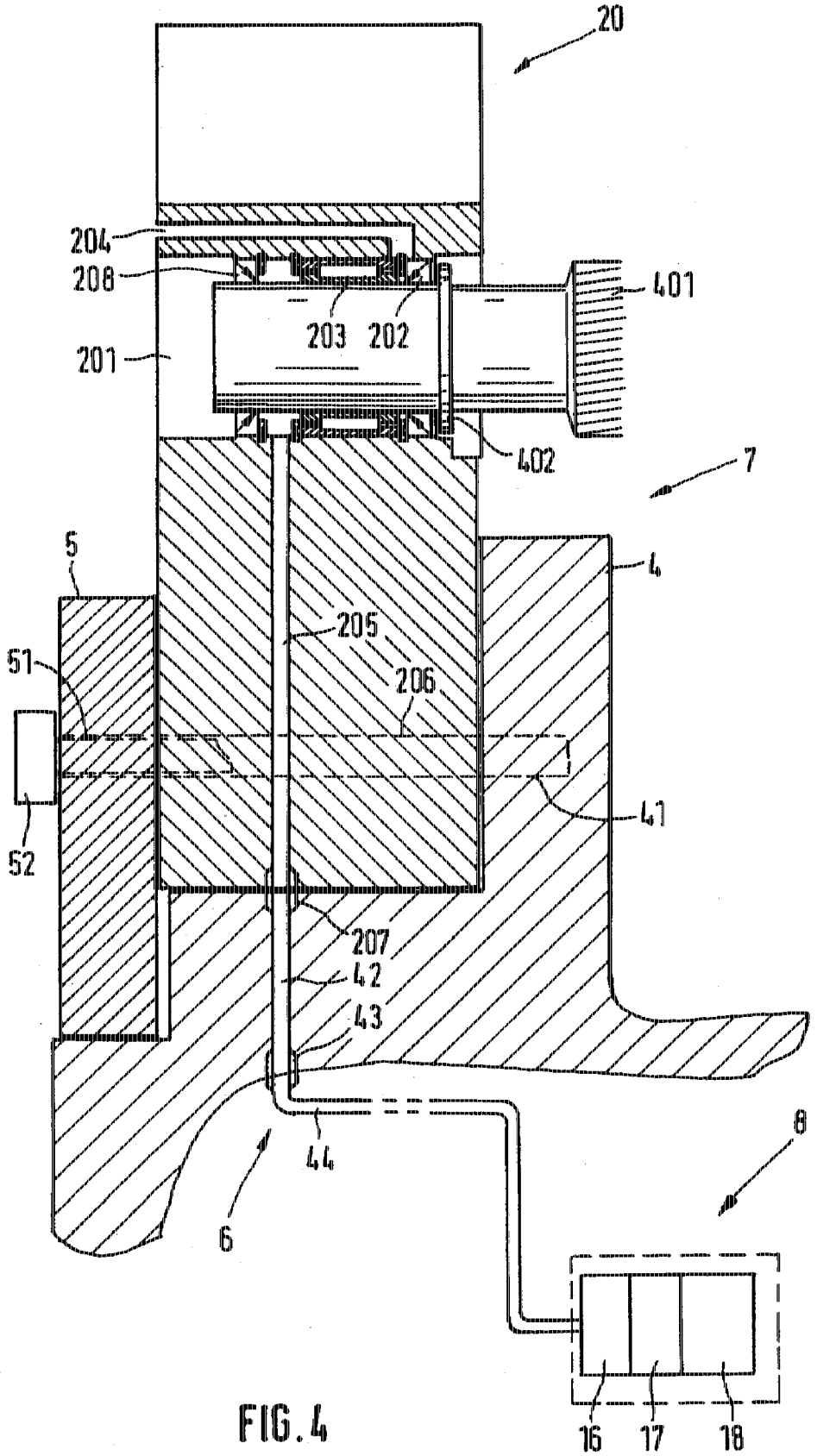
FIG. 4 shows the lubrication of the bearing of a lower roller.

FIG. 4 shows further details concerning the invention.

As can be seen, the pipeline 44 goes to a device 8 for lubricant supply. This device 8 comprises at least one container 16 for lubricant, one device 17 to produce pressure on the lubricant and controls 18 for the pressure generation. This device 8 is installed on the path 100. The controls 18 for pressure production can be integrated in the machine computer for path 100. However separate controls could also be used. The controls 18 are controlled according to the software program of a computer which determines the time of lubrication and the quantity of lubricant. The controls 18 can cause the bearing to be lubricated during the operation of the drafting equipment.

In the software program it would also be possible to control the controls so that a minimum quantity of lubricant is fed to the bearing for the operation of the drafting equipment. In this manner it is possible to minimize the quantity of lubricant to be used.

Figure 5:
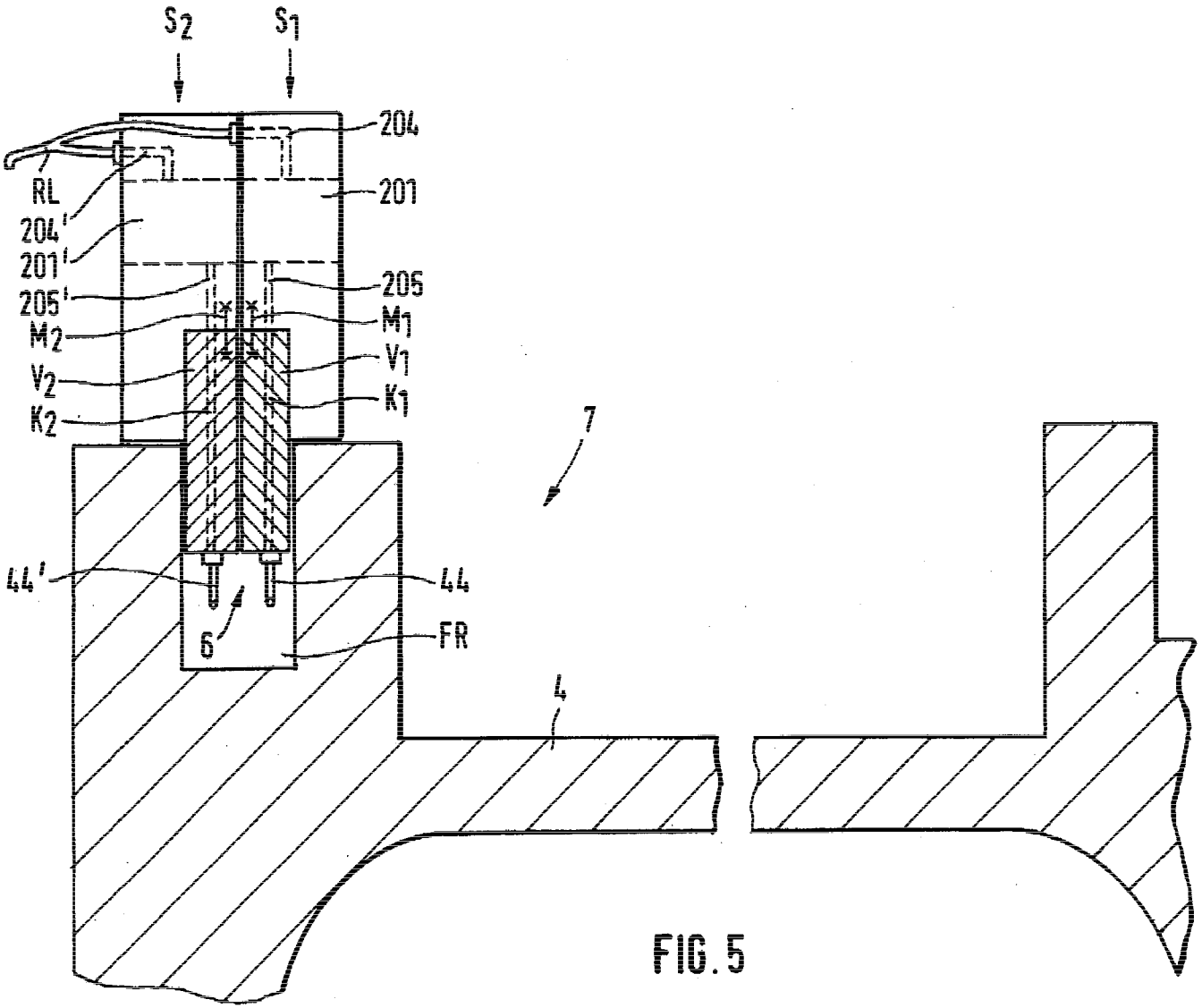
FIG. 5 shows a punched-out shape with adjusting means as part of encapsulated means.

FIG. 5 illustrates an alternative advantageous embodiment of the encapsulated means.

FIG. 5 shows a cross-section, in detail and schematically, of a drafting equipment base body 4 with punched-out shapes $S_1$, $S_2$ and appertaining adjusting means $V_1$, $V_2$. By contrast with the adjusting means according to FIGS. 3 and 4, the adjusting means according to FIG. 5 is modified. The position of the adjusting means $V_1$, $V_2$ can be adjusted and fixed so that the position of the punched-out shape also changes due to its connection to it. These actions are possible at the same time with adjusting means of a drafting roller facing each other. Such adjusting means make it possible for the corresponding drafting roller to be adjusted in longitudinal direction of the conveying path of the fiber material. Thereby the width of the drafting field between two roller pairs can be adjusted in such a drafting equipment.

According to FIG. 5, a punched-out shape $S_1$ is connected to adjusting means $V_1$ through connecting means $M_1$. The punched-out shape $S_1$ bears upon the drafting equipment base body 4 and the adjusting means $V_1$. In this example, the adjusting means $V_1$ consist of a push rod. However arrangements with a spindle as the adjusting means is also possible. The adjusting means is guided at a perpendicular to its direction of movement via stops. The adjusting means $V_1$ can be guided along the drafting equipment base body 4 and is at the same time supported and guided by the adjoining adjusting means $V_2$. Such an arrangement provides simplifications in manufacture of the drafting equipment base body. The movement of the adjusting means $V_1$ is effected by means of a drive (not shown). By means of this drive the adjusting means can be stopped. An analogous procedure applies to the punched-out shape $S_2$ with adjusting means $V_2$.

FIG. 5 furthermore shows that the adjusting means $V_1$, $V_2$ are part of encapsuled means 6. The encapsuled means 6 therefore consist of at least one adjusting means $V_1$, $V_2$, whereby the adjusting means is provided with a channel $K_1$, $K_2$ going through it. This channel $K_1$, $K_2$ is connected on the one hand directly to the channel 205, 205' of the punched-out shape $S_1$, $S_2$. On the other hand channel $K_1$, $K_2$ is connected to a pipeline 44, 44'. The pipeline 44, 44' goes to means 8 of lubricant feed. The pipeline 44, 44' is flexible, so that a movement of the adjusting means $V_1$, $V_2$ for the purpose of changing the drafting field width is not hindered.

In this embodiment the pipeline 44, 44' is advantageously laid out in the free space FR of the drafting equipment base body. The pipeline thus disappears from the operating space 7. This provides advantages in the handling of the lower rollers during maintenance by personnel. Furthermore, operating space 7 is much easier to clean, as interfering pipelines of the lubrication device are avoided.

Thanks to the double function of the adjusting means $V_1$, $V_2$ as part of an adjusting device and as part of a lubricating device, additional expenses are saved.

The device functions in that the lubricant is fed through means 8 of the lubrication system via the encapsuled means 6, consisting of pipeline 44, 44' and adjusting means $V_1$, $V_2$, via channel 205, 205' into the bearing to punched-out shape $S_1$, $S_2$. The excess lubricant is removed via channel 204, 204' of the punched-out shape $S_1$, $S_2$. In another embodiment, a pipeline RL which receives the excess lubricant and conveys it into a container can be connected to the outlet of channel 204, 204'.

Figure 6:
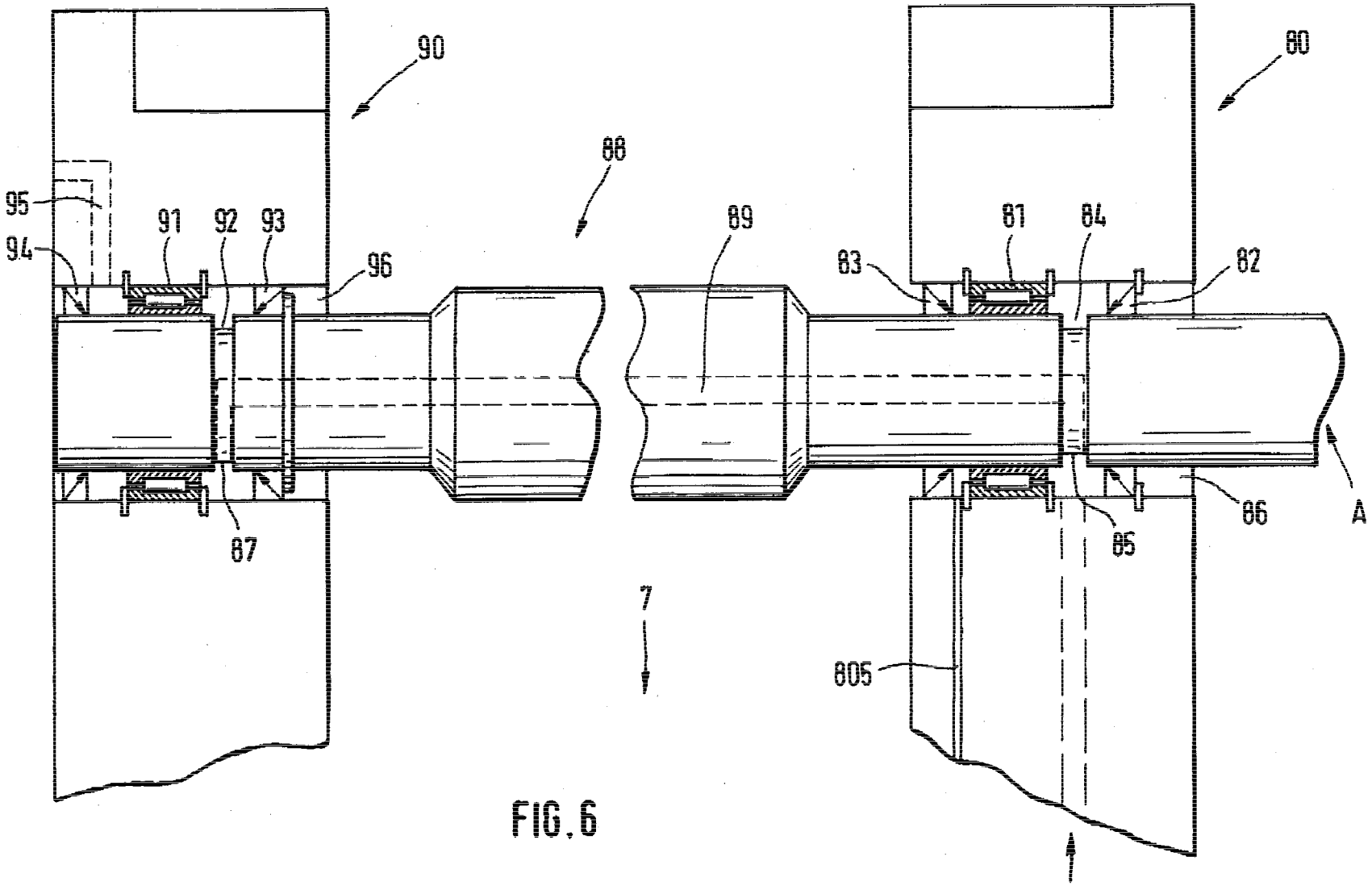
FIG. 6 shows the deflection of the lubricant from one punched-out shape to another punched-out shape by means of the lower roller.

FIG. 6 shows another advantageous embodiment of the invention. The advantage of the following solution can be seen in the fact that not only the operating space 7 is kept free of lubricant residue, but at the same time the drive side A of the lower roller 88 is kept free of lubricant residues.

Another integrated advantage of this solution is a reduced assembly cost for the lubricant feed system. FIG. 6 schematically shows the bearing of a lower roller 88 in the punched-out shapes 80, 90. The punched-out shape 80 is provided with a channel 805 through which lubricant is fed. The feed through an encapsulated means 6 is not shown. The lubricant reaches bearing 81. Bearing 81 is located in bore 86. The bearing is sealed by seals 82, 83. The lower roller 88 is provided with a groove 84. The groove has an opening 85 of a channel 89 at its surface. This channel runs in the axial direction, preferably in the direction of the axis of rotation. Lubricant can also enter the opening 85 of channel 89 and is transported through the channel 89 and its outlet 87 to the bearing 91 of punched-out shape 90. This also relates to the transportation of excess lubricant. By adding an appropriate amount of lubricant, the excess lubricant is transported through channel 89 and from there it is removed through a channel 95 in the punched-out shape 90. Channel 95 lets out at the surface of punched-out shape 90 away from the operating space. The lower roller 88 is also provided with a groove 92 in the area of punched-out shape 90, in which the outlet of channel 89 is located. The bearing 91, located in bore 96, is sealed in similar fashion by seals 93 and 94. The outlet of channel 95 can be connected with an additional line leading to a container.

It should be apparent to those skilled in the art that various modifications and variations can be made in the present device without departing from the scope and spirit of the device. It is intended that the present invention cover such modifications and variations as come within the scope of the appended claims and their equivalents.

We claim:

1. A system for lubrication of bearings of lower rollers of a textile machine drafting equipment, wherein said drafting equipment includes at least two pairs of rollers consisting of a lower roller and an upper roller received in a base body, comprising:

a base body;

punched-out shapes movably mounted on said base body, and adjusting devices configured with said base body and said punched-out shapes for positioning said punched-out shapes relative to said base body;

bores defined in said punched-out shapes for receipt of bearings for said lower rollers;

an encapsulated lubrication device for supplying lubricant to said bearings in said bores;

said encapsulated lubrication device comprising a channel defined through said punched-out shape with an outlet into said bore and an inlet in communication with channel through said base body which is in communication with a source of lubricant at one end and said punched-out shaped channel at the other end thereof; and an excess lubricant removal channel defined in said punched-out shape having an opening in communication with said bore and an outlet on a side of said punched-out shape away from said lower roller.

2. The system as in claim 1, further comprising a control device in communication with said encapsulated lubrication device for automatically controlling supply of lubricant to said encapsulated lubrication device.

3. The system as in claim 1, further comprising a container of lubricant, and a pressure source in communication with said container to pressurize said container, said control device automatically controlling said pressure source and flow of lubricant from said container.

4. The system as in claim 1, wherein said encapsulated lubrication device further comprises a channel defined in said adjusting device in communication with said punched-out shape channel.

5. The system as in claim 1, wherein said base body channel includes a pipeline in communication with said source of lubricant.

6. The system as in claim 5, wherein said pipeline is disposed in a free space defined in said base body.

7. The system as in claim 1, wherein an operating space is defined in said base body generally below said lower roller, said excess lubricant channel letting out of said base body on a side thereof opposite said operating space.

8. A system for lubrication of bearings of lower rollers of a textile machine drafting equipment, wherein said drafting equipment includes at least two pairs of rollers consisting of a lower roller and an upper roller received in a base body, comprising:

a base body, said lower rollers mounted at ends thereof on opposite sides of said base body;

punched-out shapes movably mounted on each said opposite side of said base body, and adjusting devices configured with said base body and said punched-out shapes for positioning said punched-out shapes relative to said base body;

bores defined in said punched-out shapes for receipt of bearings disposed at opposite ends of said lower rollers;

an encapsulated lubrication device for supplying lubricant to said bearings in said bores;

said encapsulated lubrication device comprising a channel defined through one of said punched-out shapes having an outlet into said respective bore and an inlet in communication with a channel through said base body which is in communication with a source of lubricant at one end and said punched-out shaped channel at the other end thereof, and a channel defined longitudinally through said lower roller having an inlet in communication with said punched-out shape bore receiving lubricant from said punched-out shaped channel and an outlet in communication with said bore in said opposite punched-out shape; and an excess lubricant removal channel defined in said opposite punched-out shape having an opening in communication with said bore and an outlet on a side of said punched-out shape away from said lower roller.

9. The system as in claim 8, wherein said encapsulated lubrication device further comprises a channel defined through said adjusting device in communication with said punched out shape channel.

10. The system as in claim 8, further comprising a control device for automatically controlling flow of lubricant through said encapsulated lubrication device.

11. The system as in claim 8, wherein an operating space is defined in said base body generally below said lower roller, said excess lubricant channel letting out of said base body on a side thereof opposite said operating space.

* * * * *